US005362103A

United States Patent [19]

Bromberg

[11] Patent Number: 5,362,103

[45] Date of Patent: Nov. 8, 1994

[54] PULL-OUT BOOKLET

[75] Inventor: Howard M. Bromberg, Riverdale, N.Y.

[73] Assignee: The Flexi/Group, Inc., Riverdale, N.Y.

[21] Appl. No.: 106,226

[22] Filed: Aug. 13, 1993

[51] Int. Cl.[5] ..... B24D 1/00

[52] U.S. Cl. ..... 281/29; 281/5; 281/15.1

[58] Field of Search ..... 281/2, 3.1, 5, 15.1, 281/29, 38; 283/34, 36, 56

[56] References Cited

U.S. PATENT DOCUMENTS

| | | | |
|---|---|---|---|
| 1,311,733 | 7/1919 | Wilmot | 283/36 |
| 2,444,853 | 7/1948 | Scharf | 281/5 |
| 2,634,777 | 4/1953 | Berger . | |
| 2,718,911 | 9/1955 | Solomon . | |
| 2,748,821 | 6/1956 | Hutchinson . | |
| 3,433,279 | 3/1969 | Seamon . | |
| 4,216,979 | 8/1980 | Janik . | |
| 4,460,676 | 7/1984 | Fabel | 281/2 |
| 4,673,197 | 3/1987 | Shtipelman et al. | 283/34 |
| 4,741,372 | 5/1988 | Santilli . | |
| 4,758,022 | 7/1988 | Podosek et al. | 281/15.1 |
| 4,877,269 | 10/1989 | Callaghan et al. | 281/15.1 |
| 5,029,902 | 7/1991 | Komori | 283/56 |

*Primary Examiner*—Richard K. Seidel
*Assistant Examiner*—Hwei-Siu Payer
*Attorney, Agent, or Firm*—Herbert Dubno

[57] ABSTRACT

An accordion folded sheet is anchored between covers and can be drawn out from between the covers by providing a notch or other opening along a free edge of one of the covers, preferably in conjunction with another notch or set back edge of the other cover so that a grippable portion of the sheet can be engaged between the thumb and forefinger of the user to facilitate extraction of the sheet and unfolding thereof as it is drawn from between the covers. The booklet is preferably of wallet size.

17 Claims, 2 Drawing Sheets

PULL-OUT BOOKLET

FIELD OF THE INVENTION

My present invention relates to a pull-out booklet and, more particularly, to an article in which a sheet between covers can be pulled out or extended so that information on the sheet will be visible to the user. The booklet is generally the size of a wallet card or credit card so that it can be received in a wallet compartment, may be utilized for advertising and promotional purposes and may have indicia on one or both covers as well as upon the sheet or sheets which are extended from the booklet.

BACKGROUND OF THE INVENTION

In U.S. Pat. No. 5,156,898, a wallet-card or credit card size article is disclosed in which a sheet of paper has two sets of concertina folds between a pair of cover members so that the sheet can be readily unfolded by drawing apart the cover members. The cover members are independent of one another and serve to protect the sheet when the latter is fully covered and lies wholly between the covers.

In U.S. Pat. No. 3,433,279, a folded member is articulated at junctions between the panels and can be accordion folded to be received within a wallet. The panels are here individual pouches or holders for respective cards. A pocket organizer utilizing similar principles is found in U.S. Pat. No. 4,741,372 and a pass case in which the individual pouches connected by folds are also joined to a pair of cover members, is found in U.S. Pat. No. 2,634,777.

As in the first system described, the cover members must be spread apart to afford access to the folded pouches. Another system utilizing folded members between covers is found in U.S. Pat. No. 4,216,979. Mention may also be made of the wallet inserts described in U.S. Pat. Nos. 2,718,911 and 2,748,821.

While all of these systems either enable the folded structure to be withdrawn from a wallet pocket or require the spreading apart of cover members to afford access to a cover member, none provides a satisfactory system for allowing a folded sheet, anchored to the cover members in a booklet, to be drawn from between the covers in a convenient and effective manner.

OBJECTS OF THE INVENTION

It is, therefore, the principal object of the present invention to provide an improved pull-out booklet and which enables a sheet to be extended out from between a pair of covers without drawbacks of earlier pull-out systems.

Another object of this invention is to provide an object which allows a folded sheet to be drawn out from between covers in a particularly convenient and effective manner.

It is also an object of the invention to provide a low cost but effective promotional, advertising or informational article which is convenient to handle.

SUMMARY OF THE INVENTION

These objects and others which will become apparent hereinafter are attained, in accordance with the present invention in a pull-out booklet in which at least one cover is formed with a notch, cut away or truncated corner or set back edge remote from the edge at which the covers are joined together and to a folded sheet between the covers, while a grippable portion of the sheet is exposed at the notch, truncated corner or set back so that this portion can be engaged by the user and withdrawn from between the covers, thereby at least partially unfolding the sheet.

More particularly, the pull-out booklet of the invention can comprise:

a front cover;

a back cover; and at least one folded sheet received between the covers and secured to the covers at one edge of the sheet and at a joining edge of the covers at which the covers are secured together, the covers having free edges generally opposite the joining edge, one of the covers having an opening along a respective free edge through which a grippable portion of the sheet is exposed, thereby enabling the portion to be engaged by fingers of a user of the booklet for extending the sheet by unfolding same from between the covers.

Advantageously, the folded sheet is provided with a plurality of folds between the joining edges and the free edges of the covers.

According to a further feature of the invention, the folds of the sheet can be accordion or concertina folds so that the sheet has a multiplicity of panels adjoining at a respective fold. The grippable portion in turn, may be provided at one such fold or, if desired, at a free edge of the sheet remote from the joining.

In one embodiment of the invention, the opening at the free edge of the cover provided with the opening is a notch in that cover. The other cover may also have such a notch advantageously aligned with the notch of the first cover.

Alternatively, the other cover can have its free edge set back toward the joining edges from the free edge of the first mentioned cover. The opening can be formed by a truncation of a corner of the first mentioned corner, i.e. by cutting of the corner thereof to expose a corner of the sheet which forms the grippable portion. The corners of the first mentioned cover can be truncated at both ends of the respective free edge to provide two locations at which the folded sheet can be gripped. The covers can be generally rectangular and the sheet can also be generally rectangular with a dimension which is at least a multiple of the corresponding dimension of the covers.

It will be apparent that the invention allows only a grippable portion of the folded sheet to be exposed and radially engaged by the fingers of the user so that the folded sheet can be withdrawn from between the covers and the sheet extended. The joining edge may be a hinge between the covers, although the covers can be attached together elsewhere as well, as long as the covers are not joined over a length of their free edges which might impede withdrawal of the folded sheet from between the covers.

BRIEF DESCRIPTION OF THE DRAWINGS

The above and other objects, features, and advantages will become more readily apparent from the following description, reference being made to the accompanying drawing in which.

SPECIFIC DESCRIPTION

Figure 1:
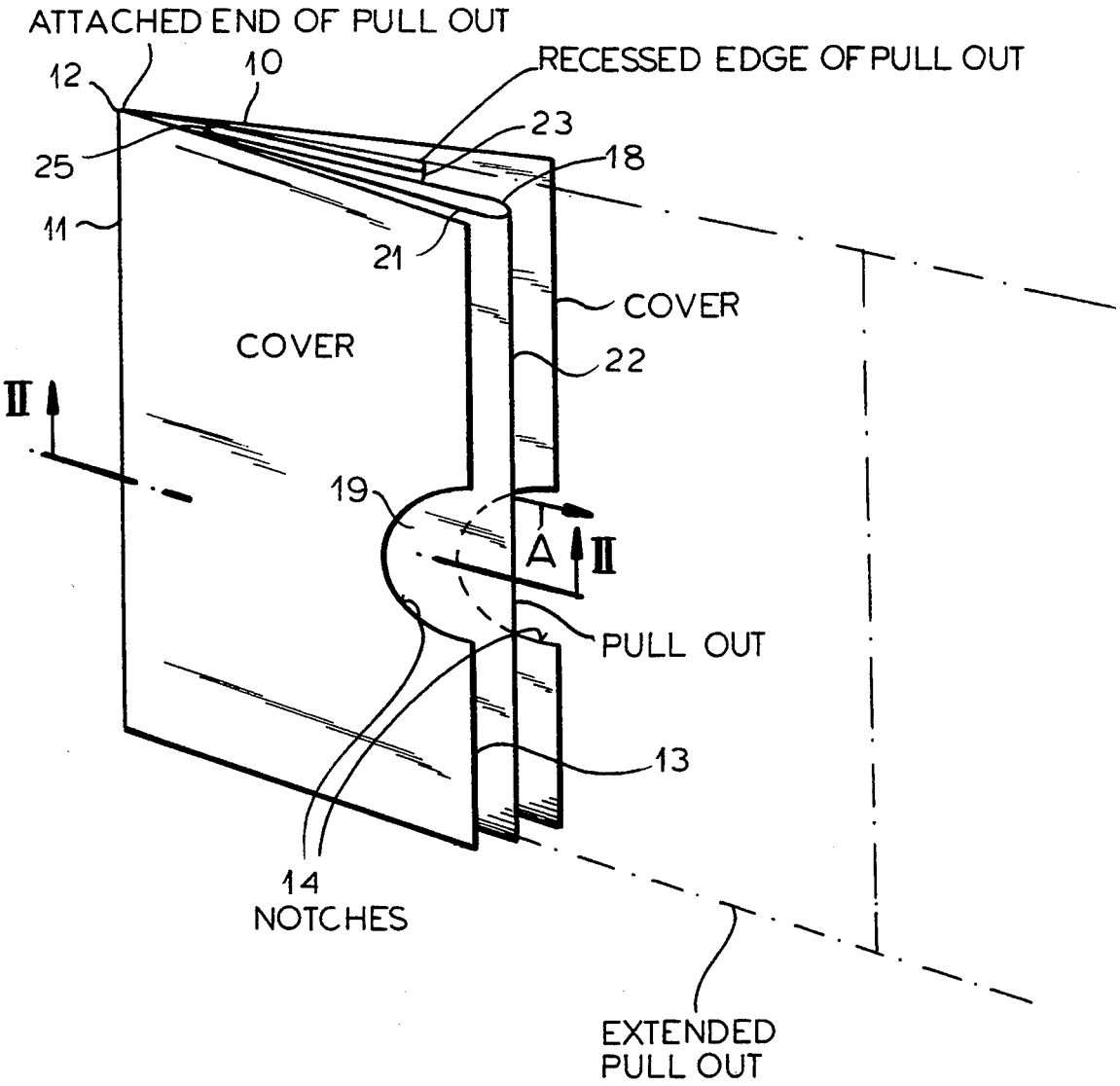
FIG. 1 is a perspective view illustrating a pull-out booklet according to one embodiment of the invention.
Figure 2:
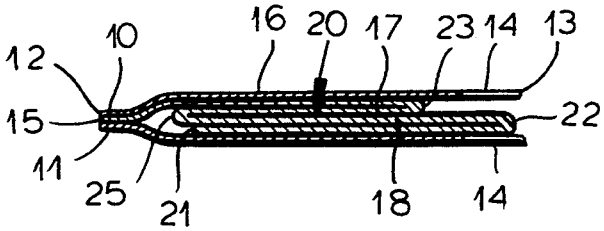
FIG. 2 is a cross sectional view taken along the line II—II of FIG. 1.

In FIGS. 1 and 2 I show a pull out booklet which comprises a pair of covers 10, 11 which are rectangular, coextensive and composed of a heavier stock than that of a folded sheet 20 received between the covers. The covers are attached together at joining edges 12 and anchored to these joining edges an edge of the folded sheet 20. The joining of the covers together and to the folded sheet can be effected by any standard edge joining means, e.g. by making the covers integral with one another at a fold at which the sheet is glued, by gluing two separate cover members together with the edge of the sheet interposed between them, by stapling, by stitching or by the use of a binder stitch or any combination thereof.

The covers have free edges 13 remote from the joining edges 12.

The folded sheet forming the pull-out in the embodiment of FIGS. 1 and 2, has a first panel 16 provided with the edge 15 which is anchored to the joining edges 12 of the covers. A fold 23 connects this panel to a panel 17 which is connected by a fold 25 to a panel 18 whose fold 22 is provided with a grippable portion 19 exposed by the notches 14 aligned with one another and form in the free edges 13 of the covers 10 and 11. The fold 22 joins another panel 21 to the panel 18.

In use, the grippable portion 19 is engaged with the thumb and finger of the hand of a user and is drawn in the direction of arrow A in FIG. 1 to extend the pull-out as represented in dot-dash lines in FIG. 1 as the accordion folds of the pullout unfold.

The covers and the sheet may be provided with appropriate indicia carrying information or provided for promotional purposes.

Figure 3:
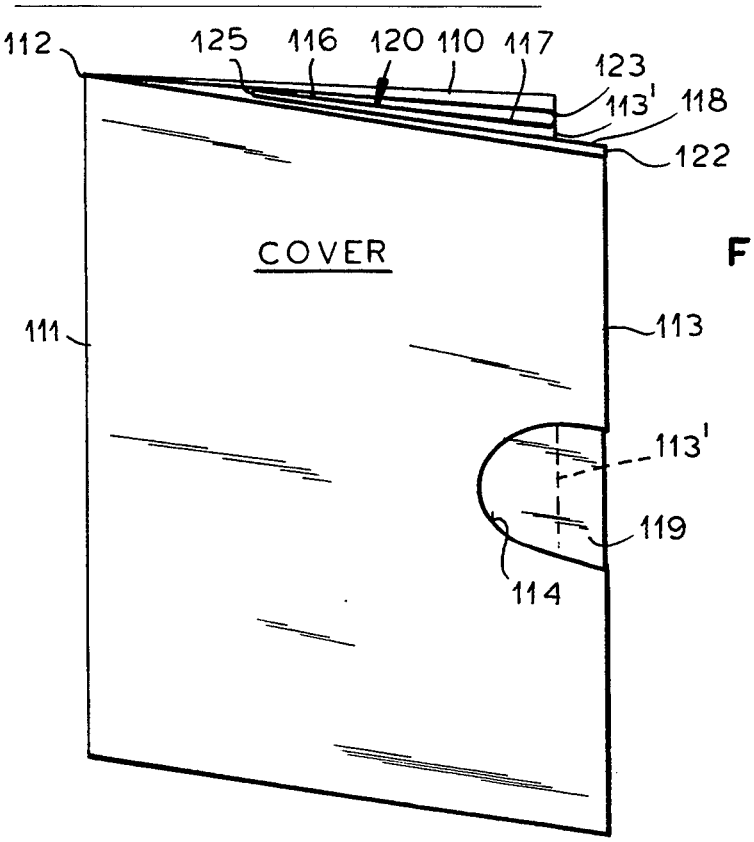
FIG. 3 is a diagrammatic perspective view like that of FIG. 1 showing another embodiment of the invention.

As can be seen with the pull-out booklet of FIG. 3, the covers 110 and 111 have joining edges 112 at which the folded sheet 120 is anchored. The folded sheet is here seen to have panels 116, 117 and 118 joining at folds 123 and 125, and a free edge 122 which is formed with the grippable portion 119 exposed by the notch 114 along the free edge 113 of the front cover 111. Here, however, instead of providing another notch along the rear of 113' of the rear cover, this edge is set back toward the joining edges 112 from the edge 113 to allow the grippable portion 119 to be gripped from between the fingers of the user.

Figure 5:
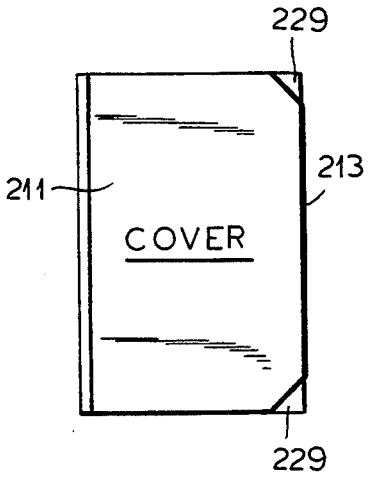
FIG. 5 is an elevational view illustrating another aspect of this embodiment.
Figure 4:
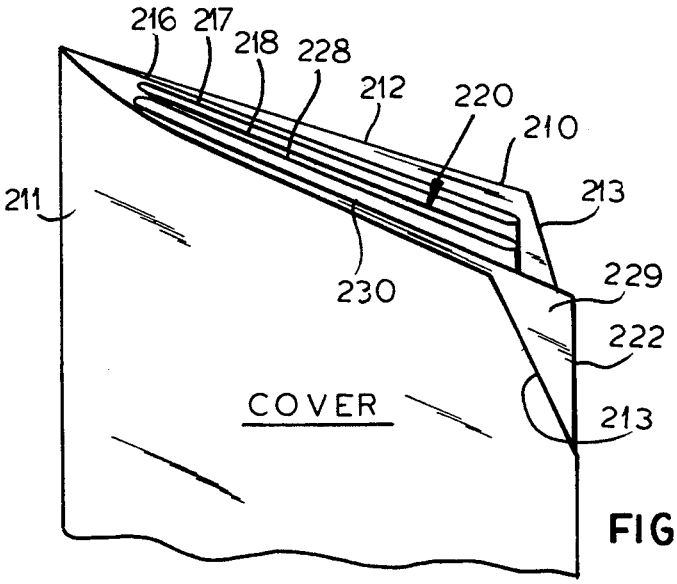
FIG. 4 is a fragmentary perspective view illustrating the truncation at corresponding corners of the two covers of the pull-out booklet.

In the booklet 210 of FIGS. 4 and 5, the covers 211 and 212 are truncated at 213 along their free edges to expose corners 229 of the folded sheet 220 along the leading edge 222 thereof. The folded sheet 220 has panels 216, 217, 218, 228 and 230 adjoining at respective folds in an accordion or concertina pattern. The truncated corners can be provided on corresponding corners of the two covers (FIG. 4) and/or on opposite corners of each cover along the edge 213 of the pull-out booklet (FIG. 5).

I claim:

1. A pull-out booklet, comprising:

a front cover;

a back cover; and at least one accordion-folded sheet having a plurality of panels and respective folds between said panels, said folds being staggered with respect to one another, said accordion-folded sheet being received between said covers and secured to said covers at one edge of said accordion-folded sheet and at a joining edge of said covers at which said covers are secured together, said covers having free edges generally opposite said joining edge, one of said covers having an opening along a respective free edge through which a grippable portion of said accordion-folded sheet is exposed when said covers are closed against said accordion-folded sheet, thereby enabling said portion to be engaged by fingers of a user of the booklet for extending said accordion-folded sheet by unfolding same from between said covers.

2. The pull-out booklet defined in claim 1 wherein said grippable portion is provided at a fold of said accordion-folded sheet.

3. The pull-out booklet defined in claim 1 wherein said grippable portion is provided at a free edge of said accordion-folded sheet.

4. The pull-out booklet defined in claim 3 wherein said opening is a notch in said one of said covers along said free edge thereof.

5. The pull-out booklet defined in claim 4 wherein each of said covers has a notch along the respective free edge, said notches being aligned.

6. The pull-out booklet defined in claim 4 wherein the other of said covers has its free edge set back toward said joining edge from the free edge of said one of said covers.

7. The pull-out booklet defined in claim 1 wherein said opening is a truncation of a corner of said one of said covers at the respective free edge.

8. The pull-out booklet defined in claim 7 wherein a corresponding corner of the other of said covers is truncated at the respective free edge of said other of said covers to expose a corner of said accordion-folded sheet.

9. The pull-out booklet defined in claim 7 wherein corners at both ends of the free edge of said one of said covers are truncated to expose corners of said accordion-folded sheet.

10. The pull-out booklet defined in claim 1 wherein said covers are generally rectangular and said accordion-folded sheet is generally rectangular with a dimension which is at least a multiple of a corresponding dimension of said covers.

11. The pull-out booklet defined in claim 10 wherein said grippable portion is provided at a free edge of said sheet.

12. The pull-out booklet defined in claim 10 wherein said opening is a notch in said one of said covers along said free edge thereof.

13. The pull-out booklet defined in claim 12 wherein each of said covers has a notch along the respective free edge, said notches being aligned.

14. The pull-out booklet defined in claim 12 wherein the other of said covers has its free edge set back toward said joining edge from the free edge of said one of said covers.

15. The pull-out booklet defined in claim 10 wherein said opening is a truncation of a corner of said one of said covers at the respective free edge.

16. The pull-out booklet defined in claim 15 wherein a corresponding corner of the other of said covers is truncated at the respective free edge of said other of said covers to expose a corner of said sheet.

17. The pull-out booklet defined in claim 15 wherein corners at both ends of the free edge of said one of said covers are truncated to expose corners of said sheet.

* * * * *